United States Patent [19]

Henry et al.

[11] 4,300,522

[45] Nov. 17, 1981

[54] COMPACT DRESSING TOOL

[75] Inventors: Robert L. Henry, Hilliard; Frank R. Skinner, Worthington, both of Ohio

[73] Assignee: General Electric Company, Worthington, Ohio

[21] Appl. No.: 150,379

[22] Filed: May 16, 1980

Related U.S. Application Data

[63] Continuation of Ser. No. 937,218, Aug. 28, 1978, abandoned.

[51] Int. Cl.[3] ..... B24B 53/00

[52] U.S. Cl. ..... 125/11 R; 125/11 CD; 125/39; 407/114

[58] Field of Search ..... 125/11 R, 11 CD, 11 IN, 125/39; 407/114

[56] References Cited

U.S. PATENT DOCUMENTS

| | | | |
|---|---|---|---|
| 2,482,784 | 9/1949 | Lohutko | 125/11 CD |
| 2,587,132 | 2/1952 | Finke | 125/39 |
| 2,914,058 | 11/1959 | Sommer | 125/11 CD |
| 3,121,982 | 2/1964 | Miller | 51/209 R |
| 3,664,068 | 5/1972 | Metzger | 51/209 R |
| 3,745,719 | 7/1973 | Oswald | 51/209 R |
| 3,898,772 | 8/1975 | Sawluk | 125/39 |
| 4,056,872 | 11/1977 | Seidel | 407/114 |

FOREIGN PATENT DOCUMENTS

| | | | |
|---|---|---|---|
| 419319 | 3/1947 | Italy | 125/39 |
| 568127 | 10/1975 | Switzerland . | |
| 690047 | 4/1953 | United Kingdom . | |

*Primary Examiner*—Harold D. Whitehead

*Attorney, Agent, or Firm*—Douglas B. Little; William S. Feiler

[57] ABSTRACT

A dresser tool comprises two composite compacts positioned to crush and shear the grinding wheel. Preferably one composite compact is arranged such that its working edge contacts the grinding wheel tangentially; and the other compact is placed so that its working edge is normal to the grinding wheel at a rake angle ranging from positive to negative.

5 Claims, 6 Drawing Figures

COMPACT DRESSING TOOL

This is a continuation of application Ser. No. 937,218, filed Aug. 28, 1978 now abandoned.

CROSS-REFERENCE TO RELATED APPLICATIONS

This application is related to the commonly assigned application of M. D. Dennis and F. R. Skinner, Ser. No. 906,288 filed May 15, 1978 and our application, Ser. No. 937,210 filed contemporaneously herewith.

BACKGROUND OF THE INVENTION

This invention relates to methods for dressing grinding wheels and, more particularly, relates to dresser tools of abrasive compacts.

Dressing may be defined as any operation performed on the face of a grinding wheel that improves its cutting action. Trueing is a dressing operation but is more precise, i.e., the face of the wheel may be made parallel to the spindle or made into a radius or special shape. Regularly applied trueing is also needed for the accurate size control of the work, particularly in automatic grinding.

Opening is another dressing operation and refers to the breaking away of the bond material from around the abrasive particles in a wheel thereby exposing them for grinding. A new wheel is initially opened and may have to be periodically opened thereafter to expose new particles when the previously exposed particles have been dislodged or dulled and to remove grinding swarf, which may accumulate during grinding, from around the abrasive particles.

Reference can be made to *Machinery's Handbook* (20th Ed. 1976) pp. 1992 to 1994 for a listing of commonly used dressing tools and methods for their use. One common type is a single point diamond tool having a granular shaped diamond mounted at one end of a tool shank. Dressing is performed with such a tool by engaging the periphery of a rotating wheel with the cylindrical handle of the tool disposed at a negative angle of 10° to 15° relative to a line drawn perpendicular to a tangent to the wheel periphery at the point of engagement of the tool with the wheel. This is equivalent to a negative back rake angle of about 55° to 60°. The tool is also occasionally rotated about its longitudinal axis to prolong diamond life by limiting the extent of the wear facets and also to produce a pyramidal shape of the diamond tip.

It is also common to use a dresser having a plurality of individual diamond mounted in an array, e.g., straight line, across the nib of the dresser. These dressers are generally referred to as multi-point or cluster type. In use, the dresser is canted at an angle of 3° to 10°, bringing two to five individual diamond points into contact with the grinding wheel. The multiple points often permit faster cross feed rates than the single point dresser.

Another method of dressing is disclosed in the above mention application of Dennis and Skinner, Ser. No. 906,288 wherein a compact abrasive dresser is disposed at a positive rake angle to the grinding wheel.

Still another type of dresser is disclosed in our above-identified application, wherein a plurality of cluster compacts or composite compacts are utilized to dress abrasive wheels.

While the prior dresser tools are generally considered to be satisfactory, manufacturers are always concerned with improving the grinding process, such as by improving the wheel life, wheel cutting speed, surface finish on the workpiece produced by the grinding wheel, dressing tool life and dressing speeds.

Present dressing techniques "glaze" the grinding wheel slightly to produce a smooth surface finish. This produces a poor cutting wheel that "burns" the object during grinding. It is desirable that the grinding wheel be both "free cutting" and capable of producing a smooth surface finish. "Free cutting" refers to a grinding wheel's capability of rapidly removing material from a workpiece and requiring low cutting energy input from the grinding machine. But the present technology, has not been able to meet the two fold criteria of free cutting and smooth surface finish because of the trade off inherent in the present dresser tools.

Accordingly, it is a feature of this invention to provide a dressing action which enhances and improves the grinding process in these areas.

Another feature of this invention is to provide an improved dressing tool particularly applicable for dressing grinding wheels which will grind workpieces and improve both free cutting and smooth surface finish characteristics.

SUMMARY

The dresser tool of the present invention includes at least two composite compacts which are positioned on the tool nib to contact the rotating surface of the grinding wheel tangentially to crush the wheel and substantially normal to shear the wheel. With this structure, two action dressing is accomplished. The order of application of shearing and crushing across the wheel may be varied depending upon the results desired. The shearing compact may be disposed at a negative, positive or zero rake angle.

In its broader aspect the present invention involves a method of dressing wherein an abrasive body is used in succession to crush and shear. The abrasive body may be diamond, cubic or wurtzitic boron nitride composite compacts or cluster compacts, a macle diamond or cemented carbide compacts.

DETAILED DESCRIPTION OF PREFERRED EMBODIMENT

Figure 1:
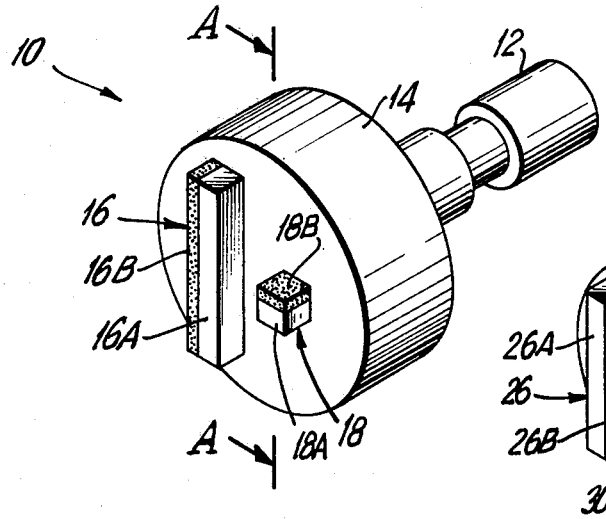
FIG. 1 is a perspective view of a double action dressing tool in accordance with the present invention.

While this invention is susceptible of embodiment in many different forms there is shown in the drawings and will hereinafter be described in detail a preferred embodiment of the invention, and modifications thereto, with the understanding that the present disclosure is to be considered as an exemplification of the principles of the invention and is not intended to limit the invention to the embodiments illustrated.

A dresser tool 10 of this invention is shown in FIG. 1. Tool 10 includes a shank or handle portion 12 and a head nib 14. Two composite compact blanks 16 and 18 are carried or embedded or otherwise attached to the nib 14 and extend therefrom. The configurations of the shank 12 and head nib 14 are illustrative and other shapes well known in the art are also useful as well.

A cluster compact is defined as a cluster of abrasive particles bonded together either (1) in a self-bonded relationship, (2) by means of bonding medium disposed between the crystals, (3) by means of some combination of (1) and (2). Reference can be made of U.S. Pat. Nos. 3,136,615; 3,141,746 and 3,233,988 for a detailed disclosure of certain types of compacts and methods for making same. (The disclosure of these patents are hereby incorporated by reference herein.)

A composite compact is defined as a cluster compact bonded to a substrate material such as cemented tungsten carbide. A bond to the substrate can be formed either during or subsequent to the formation of the cluster compact. Reference can be made to U.S. Pat. Nos. 3,745,623; 3,743,489 and 3,767,371 for a detailed disclosure of certain types of composite compacts and methods of making same. (The disclosure of these patents are hereby incorporated by reference herein.)

The term cemented carbide as used herein means one or more transitional carbides of a metal of Groups IVb, Vb, and VIb of the Periodic Table cemented or bonded by one or more matrix metals selected from the group iron, nickel and cobalt. A typical cemented carbide contains WC in a cobalt matrix or TiC in a nickel matrix.

Each of the composite blanks 16 and 18 can include a laminar substrate 16A and 18A of cemented carbide and an abrasive mass or layer 16B and 18B. Abrasive layer 16B may be comprised of an abrasive selected from the group consisting of diamond, cubic boron nitride (CBN), wurtzite boron nitride (WBN, and mixtures of two or more of the foregoing. Examples of suitable composite compacts sold by the General Electric Company under the designations: COMPAX® Industrial Diamond Tool Blanks (polycrystalline diamond on a cemented carbide substrate) and BZN Compacts (CBN crystals on a cemented carbide substrate).

Composite blank 16 is a relatively long blank and is positioned with its abrasive layer 16B in a generally vertical orientation, as viewed in FIG. 1, whereas blank 18 is shorter and positioned with its abrasive layer 18B in a generally horizontal orientation.

Figure 3:
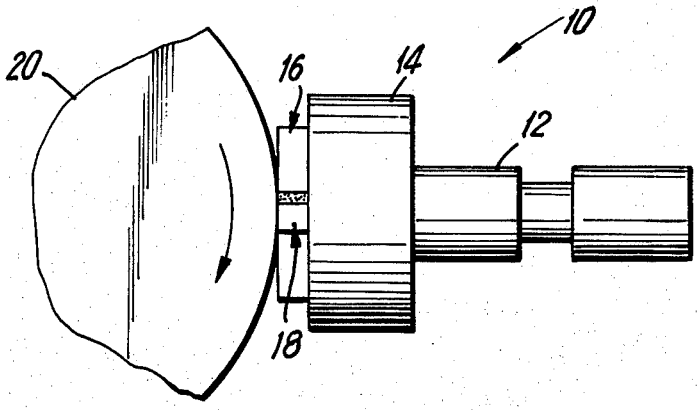
FIG. 3 is a schematic view of the double action dresser tool being applied to a rotating grinding wheel.

The functions of the blanks 16 and 18 may be best understood with reference to FIG. 3 which shows the typical application of tool 10 to the surface of grinding wheel 20 which is rotating in the direction indicated. Tool 10 is moved in two directions, namely, into and laterally across the surface of the wheel 20. Blank 16 functions to crush the grinding wheel and blank 18 shears the wheel.

The long blank 16 extends beyond the wheel contact region as shown in FIG. 3. The action of the long blank 16, because of contact angles, crushes the grinding wheel. This function breaks bond posts in bonded wheels, exposing new grains of abrasives and fractures existing exposed grains.

Figure 2A:
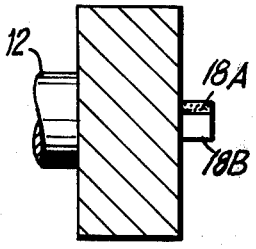
FIGS. 2A, 2B and 2C are fragmentary cross-sectional views, typically taken along line AA in FIG. 1, showing the shearing compact set at zero, positive, and negative rake angles, respectively.
Figure 2B:
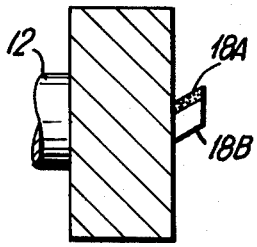
Figure 2C:
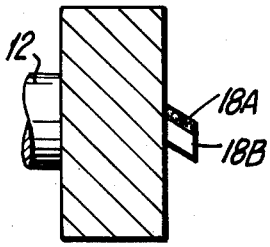

The short blank 18 is positioned substantially near the grinding wheel contact radius. The short blank 18 shears the wheel grains establishing exact grinding wheel diameter and a "free cutting" state. The short blank rake angle may be zero, positive or negative as shown in FIGS. 2A, 2B and 2C, respectively. Rake angle refers to the angle of engagement of dresser tool with the grinding wheel as measured from the tool table as a plane of reference. A table of a dressing tool is the tool surface against which chips of the grinding wheel bear as they are severed. In any rake orientation the leading abrasive edge of blank 18 is essentially orthogonal to the leading abrasive edge of blank 16.

In this manner the working edge of compact 16 engages the wheel surface aligned substantially parallel to the direction of wheel rotation and compact 18 engages the wheel surface with its working edge substantially transverse to the direction of wheel rotation. The working edge of compact 18 should engage the wheel surface at a position adjacent to the point of tangency of the working edge of compact 16 to the wheel surface.

The double action (crush-shear) tool 10 can be used two ways, depending upon which blank 16, 18 crosses the wheel 20 first during dressing. If the long blank 16 precedes the short one 18, crushing and then shearing, a smooth, stable, free-cutting wheel surface will be produced. The action of the short blank 18 will dimensionally stabilize the wheel 20 and open it a bit, especially if the blank is used at a positive rake.

If the tool 10 is used with the short blank 18 preceding the long blank 16, shearing is the predominant dressing mode. However, tool wear is greater for the short blank, exposing more of the long blank to the wheel and causing a crushing action. Dimensional control is excellent, but dimensional stability drops due to broken bond posts during the crushing action.

Figure 4:
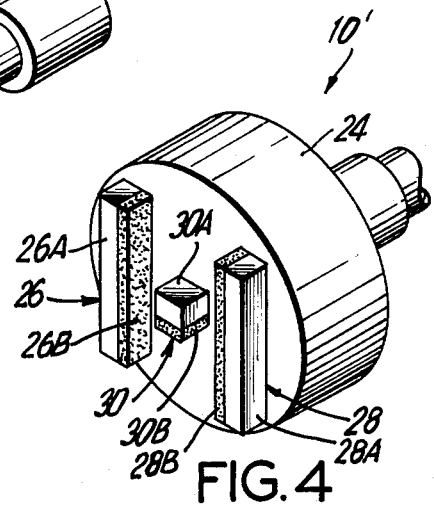
FIG. 4 is alternative embodiment of an oscillatory, double action dressing tool.

FIG. 4 shows an alternative tool 10′ which is especially useful for surface grinders and other machines where the tool 10′ oscillates making several dressing passes across the grinding wheel. Tool 10′ employs two crushing blanks 26 and 28 and one shearing blank 30. Composite compact blanks 26, 28 and 30 are embedded in or attached to nib 24 and include respectively, substrate 26A, 28A, 30A and abrasive 26B, 28B, 30B, as described above. The structure of tool 10′ assumes that a crushing blank 26 or 28 will always precede the shearing blank 30 as the tool is oscillated across the face of the grinding wheel.

The orientation of blanks 26 and 30 may be rotated 180° from that shown in FIG. 4. Blank 28 should be oriented as shown. Blank 30 may, of course, have a positive, zero, or negative rake angle as shown in FIGS. 2A-2C.

While the invention has been described in terms of illustrative tools, it is clear that in its broadest aspects the invention also includes a method of dressing wherein a abrasive is passed in a controlled orientation in successive passes across a grinding wheel to crush and shear. Thus, while this method may be conveniently practised with the use of a pair of blanks, FIG. 1, or three blanks, when oscillation is used, FIG. 4, it is possible to practise the method with a single blank.

The single blank method would include contacting the grinding wheel with the blank oriented substantially parallel to the direction of wheel rotation to crush during the first pass (as blank 16, FIG. 1).

The second pass would subject the wheel to a shearing action by rotating the abrasive 90° about the tool handle axis and moving it across the wheel surface. As discussed previously, the order of the first and second pass may be reversed.

The abrasive may be of a cluster compact or composite compact of diamond, cubic boron nitride, or wurtizitic boron nitride or a macle diamond (a thin, triangular shaped natural diamond in combination with a long needle-shaped crystal), or cemented carbide compacts.

These and other modifications may be made by these skilled in the art without departing from the scope and spirit of the present invention as pointed out in the appended claims.

What is claimed is:

1. An improved multi-point dressing tool for grinding wheels comprising a shank portion and a nib and having at least two composite compacts positioned on the nib wherein a composite compact comprises:

(a) a mass comprising at least 70 volume percent of an abrasive selected from the group consisting of diamond and cubic boron nitride particles which are bonded together and wherein there is crystal-to-crystal bonding in the case of diamond, and which mass is bonded to;

(b) a substrate mass of cemented carbide selected from the group consisting of tungsten, titanium, and tantalum carbides; wherein the improvement comprises a dressing tool means having a first composite compact crushing means with a leading abrasive edge and a second composite compact shearing means with a leading abrasive edge, said first composite compact being positioned on said nib such that its leading edge contacts the rotating surface of the grinding wheel tangentially to crush the wheel and said second composite compact being positioned such that its leading edge is normal to the grinding wheel surface to shear the wheel.

2. The improved dressing tool of claim 22, wherein said first and second composite compacts present edges in a substantially orthogonal relationship.

3. The improved dressing tool of claim 2 wherein said second composite compact is set at a positive rake angle.

4. A double action dressing tool for a grinding wheel comprising (a) a body defining a nib said nib having first, second, and third composite compacts extending therefrom;

(b) wherein a composite compact comprises: (1) a mass of at least 70 volume percent of an abrasive selected from the group consisting of diamond and cubic boron nitride particles bonded together wherein there is crystal-to-crystal bonding in the case of diamond, and which mass is bonded to; (2) a substrate mass of a cemented carbide selected from the group consisting of tungsten, titanium, and tantalum carbides;

(c) said first and third composite compacts comprising crush dressing means each presenting an elongate abrasive working edge to tangentially contact and crush the grinding wheel periphery; and (d) said second composite compact comprising shear dressing means presenting a working edge transverse to the direction of wheel rotation to shear the grinding wheel.

5. The dressing tool of claim 4, wherein said second composite compact is set at a positive rake angle.

* * * * *